US010076144B2

(12) United States Patent
Rivera

(10) Patent No.: US 10,076,144 B2
(45) Date of Patent: Sep. 18, 2018

(54) ELONGATED WRIST TOWEL WITH ELASTIC RIM AND SEAM

(71) Applicant: Migdalia Rivera, Miramar, FL (US)

(72) Inventor: Migdalia Rivera, Miramar, FL (US)

( * ) Notice: Subject to any disclaimer, the term of this patent is extended or adjusted under 35 U.S.C. 154(b) by 18 days.

(21) Appl. No.: 14/943,625

(22) Filed: Nov. 17, 2015

(65) Prior Publication Data

US 2017/0135426 A1 May 18, 2017

(51) Int. Cl.

| | |
|---|---|
| ***A41D 20/00*** | (2006.01) |
| ***A47K 10/02*** | (2006.01) |
| ***A41D 13/08*** | (2006.01) |
| ***A41D 27/10*** | (2006.01) |

(52) U.S. Cl.

CPC ..... *A41D 20/00* (2013.01); *A41D 13/088* (2013.01); *A41D 27/10* (2013.01); *A47K 10/02* (2013.01)

(58) Field of Classification Search

CPC ..... A41D 13/08; A41D 13/088; A41D 20/00; A41D 27/10; A41D 27/12; A41D 17/00; A41D 17/02; A41D 13/1227; Y10S 2/917

USPC .... 2/1, 16, 22, 59, 125, 126, 170, 455, 917, 2/162, 910; 602/62–64

See application file for complete search history.

(56) References Cited

U.S. PATENT DOCUMENTS 699,802 A * 5/1902 Mendelsohn ..... A41D 20/00 2/162
1,117,077 A * 11/1914 Mooney ..... A41D 13/08 2/16
1,227,052 A * 5/1917 Hogan ..... A41D 13/08 2/59
1,284,536 A * 11/1918 Yaeger ..... A41D 13/08 2/59
3,648,291 A * 3/1972 Pankers ..... A61F 13/069 128/892
3,657,741 A * 4/1972 Blanco ..... A41D 13/08 2/59
4,474,573 A * 10/1984 Detty ..... A61F 13/061 2/24
4,832,010 A * 5/1989 Lerman ..... A61F 2/7812 2/16
5,139,479 A * 8/1992 Peters ..... A61F 5/0111 602/27
5,168,577 A * 12/1992 Detty ..... A41D 13/08 2/16
5,628,062 A * 5/1997 Tseng ..... A41D 13/08 2/16
5,878,435 A * 3/1999 Kast ..... A41D 13/08 2/159
D442,765 S * 5/2001 Newman ..... D2/610
(Continued)

*Primary Examiner* — Jameson Collier
(74) *Attorney, Agent, or Firm* — The Keys Law Firm PLLC

(57) ABSTRACT

An elongated wrist towel for wearing on a user's wrist without exerting circumferential pressure over a large portion of the user's arm includes a towel body defining a hollow, elongated sleeve and is sized to encircle the distal arm of a user. The towel body includes an elastic distal edge which allows the elongated wrist towel to be secured to a user's wrist, a non-elastic proximal edge, and an elastic seam which runs longitudinally between the proximal edge and the distal edge. In this regard, when in place on a wearer's arm, the elongated wrist towel can be retained on the wrist through compression from a single rim and selectively moved between extended and compacted positions on a user's arm.

12 Claims, 4 Drawing Sheets

(56) References Cited

U.S. PATENT DOCUMENTS

| | | | | |
|---|---|---|---|---|
| 6,272,688 | B1 * | 8/2001 | Wilson | A41D 13/01 2/16 |
| 6,430,744 | B1 * | 8/2002 | Redman | A41D 13/08 2/16 |
| 6,449,772 | B1 * | 9/2002 | Donner | A41D 13/088 2/16 |
| 6,813,779 | B1 * | 11/2004 | Williams | A41D 13/08 2/16 |
| 9,301,891 | B1 * | 4/2016 | Childress | A41D 27/12 |
| 9,675,124 | B2 * | 6/2017 | Vito | A41D 13/08 |
| 2003/0074709 | A1 * | 4/2003 | Donaldson | A41D 13/1236 2/16 |
| 2007/0028345 | A1 * | 2/2007 | McCarty | A41D 13/08 2/59 |
| 2009/0151045 | A1 * | 6/2009 | Hinds | A41D 20/00 2/170 |
| 2011/0314581 | A1 * | 12/2011 | Gaters | A41D 27/12 2/16 |
| 2015/0101094 | A1 * | 4/2015 | Hinds | A41D 13/08 2/16 |

* cited by examiner

ELONGATED WRIST TOWEL WITH ELASTIC RIM AND SEAM

BACKGROUND OF THE INVENTION

Field of the Invention

This invention relates generally to apparel and, more particularly, to an elongated towel adapted to be worn around the distal end of a user's arm.

Description of the Prior Art

The use and design of a conventional wristband, generally defined as an encircling member which may be decorative or functional and is worn on or adjacent to the wrist, is well known. Wristbands used in a variety of contexts, including for purposes of hygiene, identification, access control, fashion, activism, and sporting equipment.

Because wristbands are deployed in so many different ways, there are many different styles of wristbands. Indeed, the style of a wristband, including the specific design and material composition, will generally vary in order to ensure it is suitable for the intended use. For example, wristbands having the form and composition of a sweatband are well established for use to wipe or otherwise absorb sweat during some activity (commonly athletic). Such sweatband style wristbands are typically have an exterior which is suited to absorb large amounts of water, such as a terrycloth or other fabric material, and a full elastic body which allows it to stretch circumferentially along its entire length.

A problem which still exists, however, is that the nature of the full elastic body conventional sweatband style wristbands often causes such a wristband to exert too much pressure on the distal end of a wearer's arm. Thus, there remains a need for an elongated wrist towel whose elasticity was limited to a circumferential rim and a longitudinal seam. It would be helpful if such an elongated wrist towel enabled selective resizing of the amount longitudinal length exposed at a given moment. It would be additionally desirable for such an elongated wrist towel was able to remain in place with exerting circumferential pressure on a wearer's arm throughout the entire portion of the arm covered thereby.

The Applicant's invention described herein provides for an elongated wrist towel adapted be worn at the distal end of a wearer's arm, on or adjacent to a wearers wrist without exerting circumferential pressure over a large portion of the wearer's arm. The primary aspects of Applicant's elongated wrist towel are a towel body, an elastic rim, and an elastic seam. When in operation, the elongated wrist towel enables effective sweat management and real time size adjustment through selective positioning of elastic portions. As a result, many of the limitations imposed by prior art structures are removed.

SUMMARY OF THE INVENTION

An elongated wrist towel for wearing on a user's wrist without exerting circumferential pressure over a large portion of the user's arm. The elongated wrist towel comprises a towel body defining a hollow, elongated sleeve and is sized to encircle the distal arm of a user. The towel body includes an elastic distal edge which allows the elongated wrist towel to be secured to a user's wrist, a non-elastic proximal edge, and an elastic seam which runs longitudinally between the proximal edge and the distal edge. In this regard, when in place on a wearer's arm, the elongated wrist towel can be retained on the wrist through compression from a single rim and selectively moved between extended and compacted positions on a user's arm.

It is an object of this invention to provide an elongated wrist towel whose elasticity was limited to a circumferential rim and a longitudinal seam.

It is another object of this invention to provide an elongated wrist towel which enables selective resizing of the amount longitudinal length exposed at a given moment.

It is yet another object of this invention to provide an elongated wrist towel able to remain in place with exerting circumferential pressure on a wearer's arm throughout the entire portion of the arm covered thereby.

These and other objects will be apparent to one of skill in the art.

DETAILED DESCRIPTION OF THE INVENTION

Figure 1:
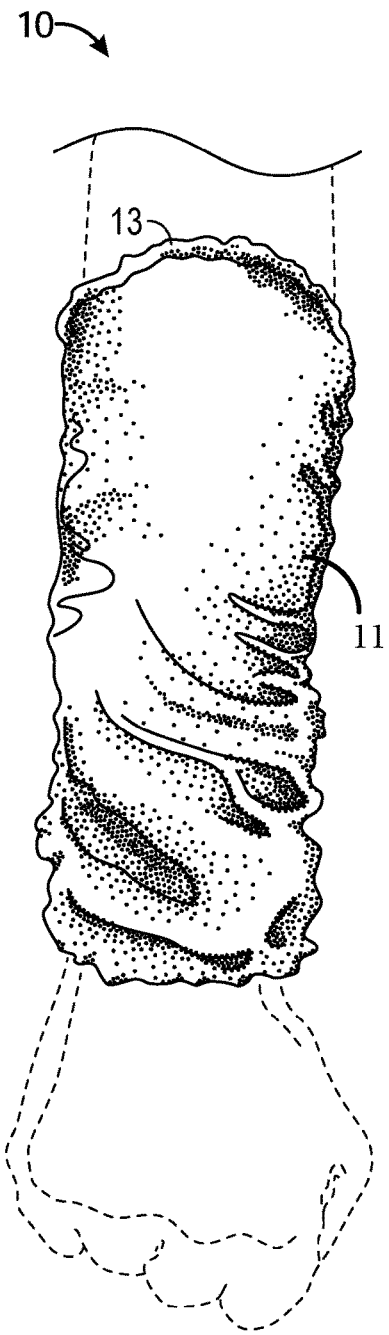
FIG. 1 is a top plan view of an elongated wrist towel bar built in accordance with the present invention in a fully extended position on a wearer's arm.

Referring now to the drawings and in particular FIGS. 1, 2, 3, 4, 5, 6, 7, 8, 9, and 10, an elongated wrist towel 10 is shown having a towel body 11, a distal edge 12, a proximal edge 13, and a longitudinal seam 14. The towel body 11 defines an elongated sleeve sized to be worn around the arm of a wearer. Accordingly, the towel body 11 is hollow, and includes opposing open ends, thereby allowing the towel body 11 to be slid over the wearer's hand onto the wrist and forearm of the wearer.

Figure 2:
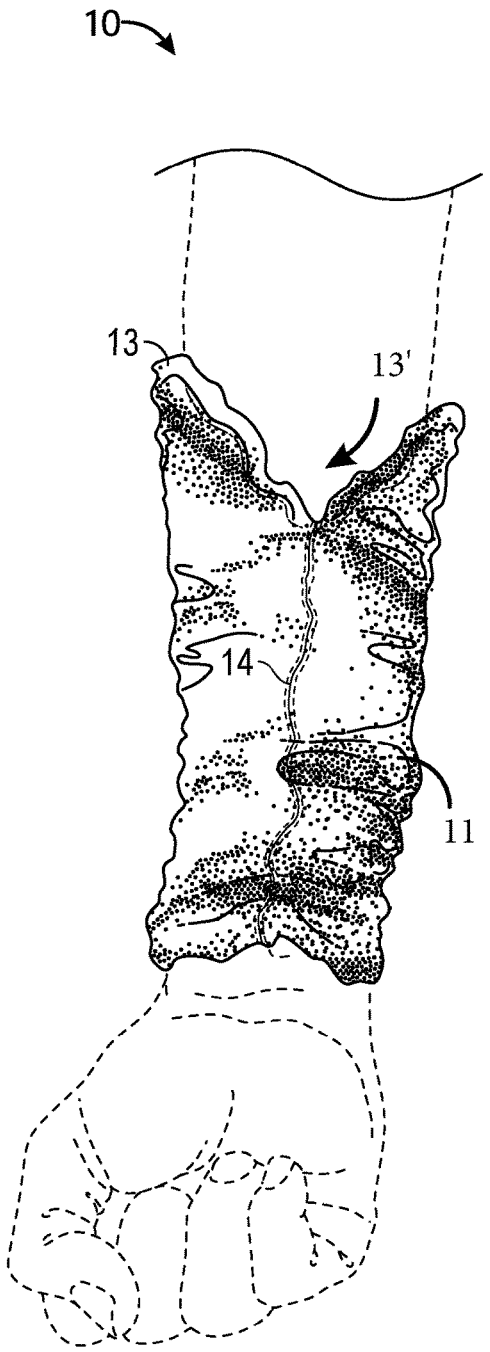
FIG. 2 is a bottom plan view of an elongated wrist towel bar built in accordance with the present invention in a fully extended position on a wearer's arm.
Figure 3:
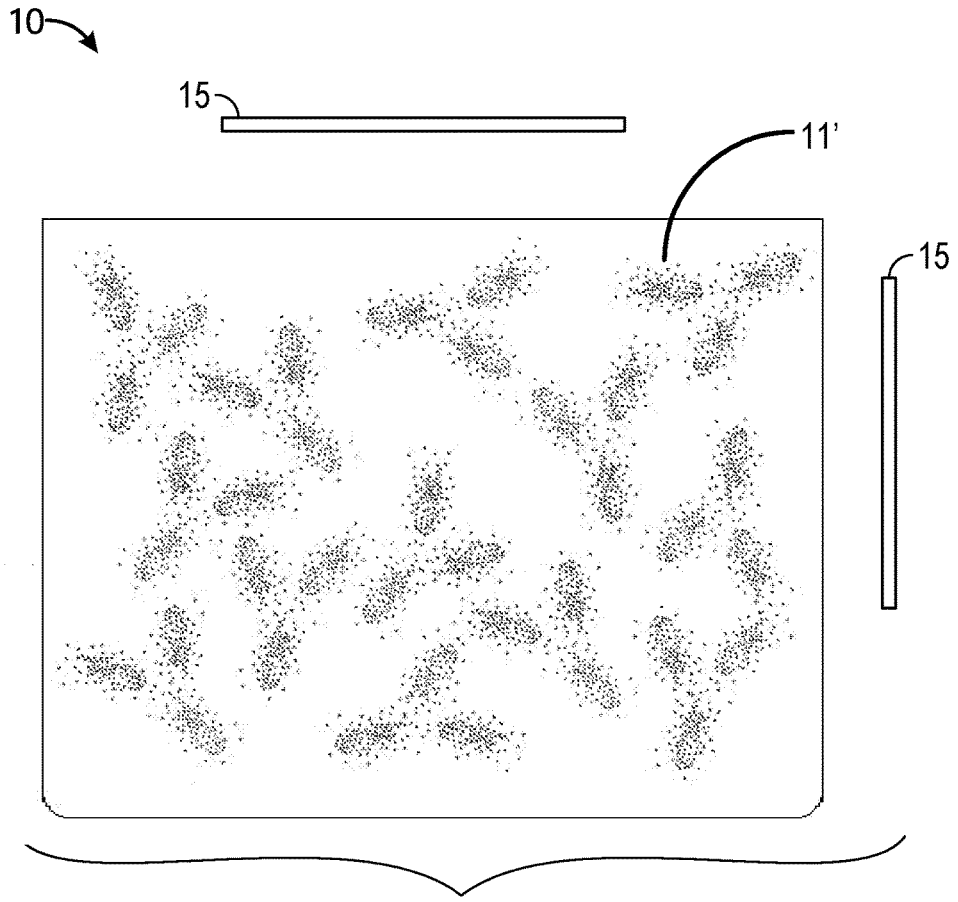
FIG. 3 is a top plan view of the unassembled towel body and elastic strips of an elongated wrist towel bar built in accordance with the present invention.
Figure 4:
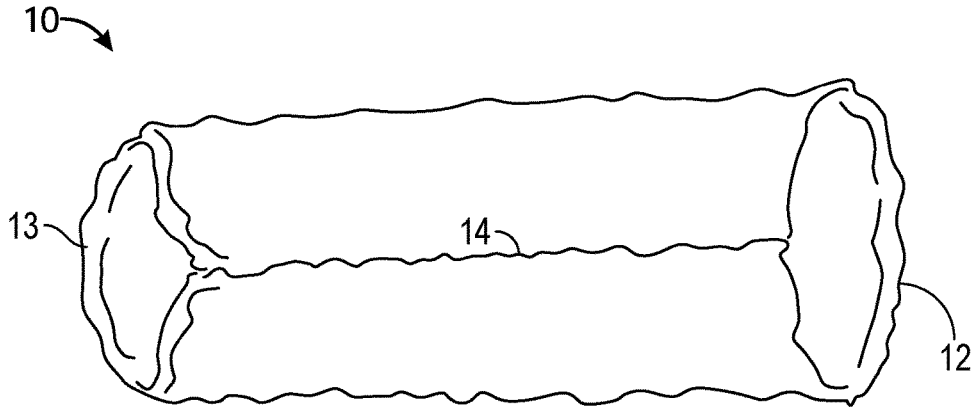
FIG. 4 is a side perspective view of an elongated wrist towel bar built in accordance with the present invention in a fully extended position.
Figure 7:
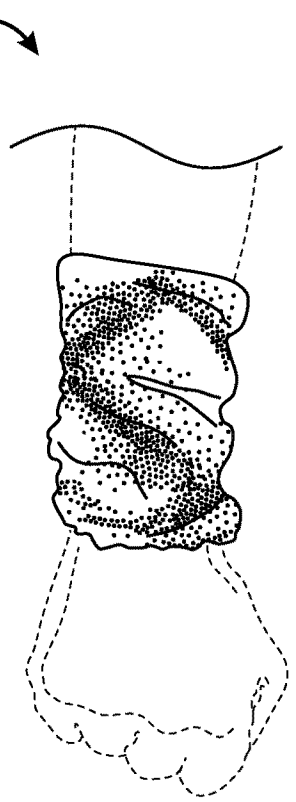
FIG. 7 is a top plan view of an elongated wrist towel bar built in accordance with the present invention in an intermediate position on a wearer's arm.
Figure 6:
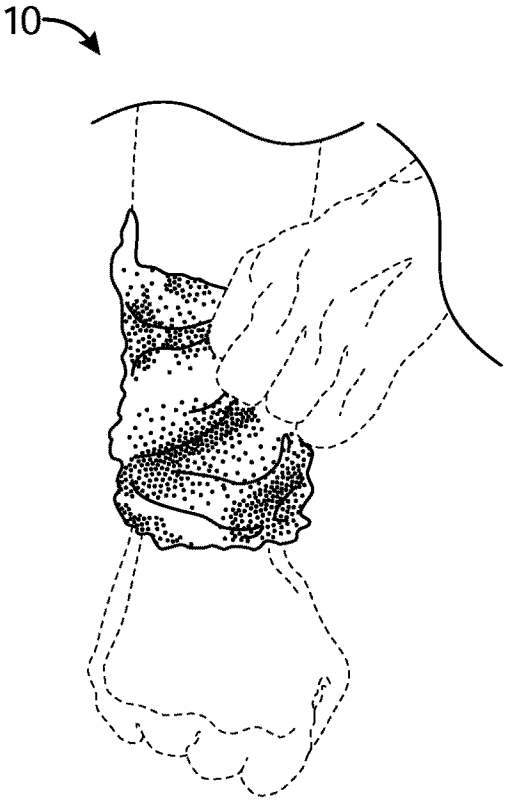
FIG. 6 is a top plan view of an elongated wrist towel bar built in accordance with the present invention being tucked from a fully extended position.
Figure 5:
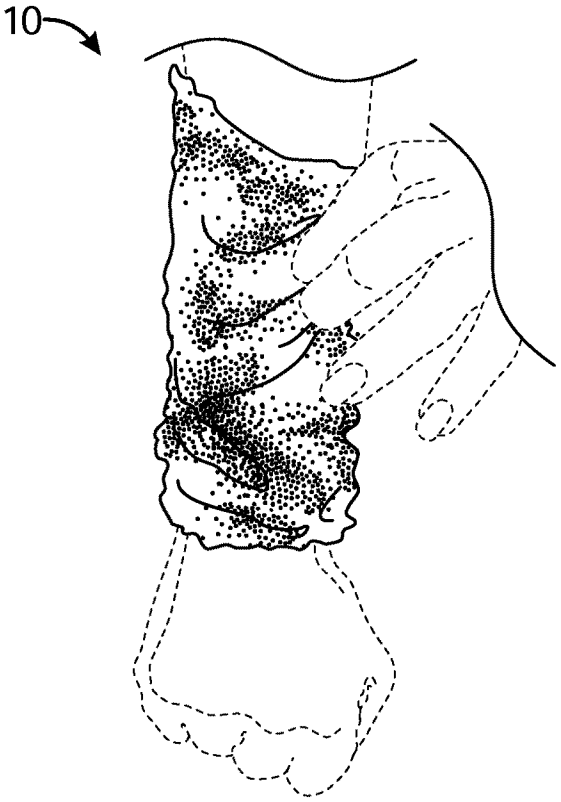
FIG. 5 is a top plan view of an elongated wrist towel bar built in accordance with the present invention being folded from a fully extended position.
Figure 10:
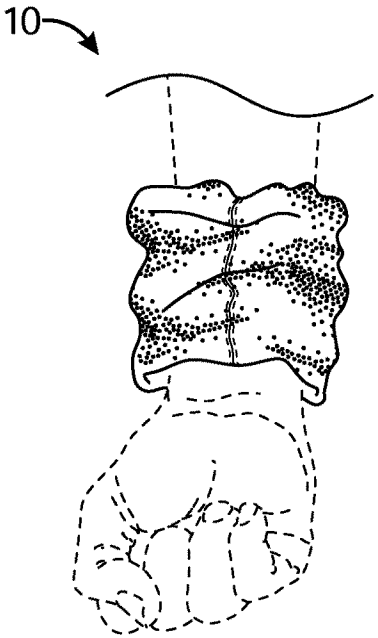
FIG. 10 is a bottom plan view of an elongated wrist towel bar built in accordance with the present invention in a fully compacted position on a wearer's arm.
Figure 9:
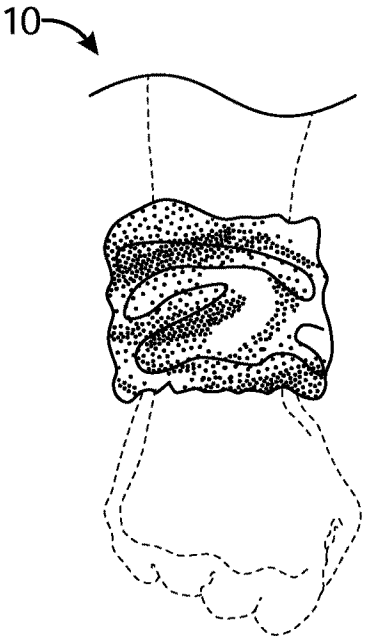
FIG. 9 is a top plan view of an elongated wrist towel bar built in accordance with the present invention in a fully compacted position on a wearer's arm.
Figure 8:
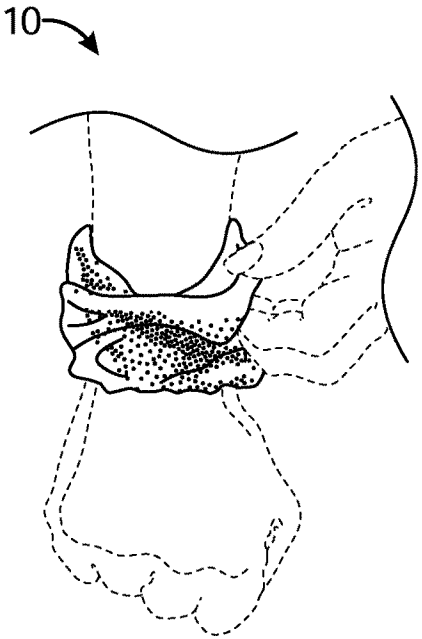
FIG. 8 is a top plan view of an elongated wrist towel bar built in accordance with the present invention being folded and tucked into a fully compacted position.

In the preferred embodiment, the towel body 11 is formed from a 12 inch by 12 inch towel base 11' that has a pair of square corners and a pair of rounded corners (as illustrated by FIG. 2), with two of its opposing edges sewn together. The longitudinal seam 14 is created along the length of the towel body 11 at the location where the opposing edges of the towel base 11' are sewn together in said preferred embodiment.

It is contemplated that the opposing edges of the towel base 11' may be fastened together in alternate manners and the longitudinal seam 14 may be formed through alternate techniques in accordance with the present invention.

In one embodiment, the towel body 11 is constructed of terrycloth. It is appreciated, however, that in various embodiments, the towel body 11 may be constructed of alternate materials.

The distal edge 12 is defined by an elastic rim which is operative to reduce the circumference of the distal edge 12 from the size of the underlying towel base 11' (12 inches in the illustrated embodiment). This reduction in circumference is operative to prevent the wrist towel 10 from inadvertently sliding over the wrist and off of a wearer without being exerting inward pressure on the wrist. In the preferred embodiment, the distal edge 12 defines a contiguous elastic rim formed where the square corners of the towel base 11' attach and includes a 6 inch long, ⅛ inch wide elastic member 15 sewn into a ⅜ inch slot integral with and extending around the distal edge 12. It is appreciated that the in other embodiments, elastic material may be integrated with the distal edge 12 in alternate manners. For example, in one alternate embodiment the distal edge 12 includes a stretch fabric or other elastic material and attached to the towel body 11.

In the preferred embodiment, the proximal edge 13 defines an irregular rim which includes the attached the rounded corners of the towel base 11'. It is contemplated that this irregular rim is formed from joining of rounded corners, creating "V" shaped indentation 13' that measures 1½ inches in the illustrated embodiment, such that the V-shaped indentation has a length that is substantially equal to an eighth of the first length of the towel body. It is contemplated that this indentation 13' makes it easier to fold and tuck the proximal end of the wrist towel 10 under the towel body 11 when reducing the size of the wrist towel 10 (and to unfold and untuck when extending the wrist towel 10 back to its full length (or some longer length than its present length).

The longitudinal seam 14 is includes by an elastic strip which is operative to reduce the length of the towel body 11 from the size of the underlying towel base 11' (12 inches in the illustrated embodiment). In the preferred embodiment, the longitudinal seam 14 includes a contiguous elastic strip which includes a 6 inch long, ⅛ inch wide elastic member 15 disposed in an opening which extends from where the square corners of the towel base 11' are fastened together (at the distal edge 12) to the where the rounded corners of the towel base 11' are fastened together (at the proximal edge 12). It is appreciated that the in other embodiments, elastic material may be integrated with the longitudinal seam 14 in alternate manners.

In use, the reduction in size of the distal edge 12 from the integration of the elastic member 15 allows the elongated wrist towel 10 to be securely positioned around the wrist/forearm of a wearer. Advantageously, other than at the distal edge 12, no circumferential compression force is exerted on a wearer's arm to maintain the elongated wrist towel 10 in place thereon. Indeed, aside from the distal edge 12, the towel body 11 generally has a circumference of 12 inches. In the preferred embodiment, when the distal edge 12 is fully stretched, it is able to reach the same circumference.

Furthermore, it is contemplated that the wrist towel 10 may be selectively resized while being worn by a user. Specifically, by repeatedly folding and tucking a portion of the wrist towel 10 under the towel body 11, beginning at the proximal edge 13 and continuing towards the distal edge 13, the length of the elongated wrist towel 10 may be progressively reduced to some intermediate position between fully extended and fully compacted (illustrated as a 6 inch intermediate position shown in FIG. 7) or even all the way to a fully compacted position in which it measures 3 inches (illustrated in FIGS. 9 and 10). When the wrist towel 10 is not fully extended, its length can be extended to reveal more of its length by untucking and unfolding portions of the towel body 11 which have been previously folded and tucked. Accordingly, significantly more surface area for absorbing sweat can be selectively availed when desired by a user.

It is contemplated that the elasticity of the longitudinal seam 14 is operative to keep folded and tucked portions of the towel body 11 in place until manually untucked and unfolded by a user thereby adapting the elongated wrist towel 10 to be selectively maintained in progressively extended and compacted positions.

It is appreciated that as the length of elastic member 15 integral with the longitudinal seam 14 is substantially shorted than the length of the towel body 11, the elastic member 15 will naturally bias the portion of the proximal edge 13 adjacent to the longitudinal seam 14 towards the distal edge 12.

It is contemplated that the towel base 11 may be alternatively define rectangular towels with varying style corners and with varying dimensions.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An elongated wrist towel, comprising:

a towel body configured as a hollow, discrete sleeve with a first open end and an opposing second open end, wherein said towel body includes a longitudinal seam that extends between the first open end and the second open end;

said towel body having a first circumference and a first length, with the first circumference being the circumference of the towel body as measured at a location between the first open end and the second open end, and the first length being a longitudinal length of the towel base as measured at a location on the towel body that is opposite to the longitudinal seam;

a distal edge integral with the towel body which defines an elastic rim at the first open end, wherein said distal edge, when relaxed, reduces the circumference of the towel body at the distal edge to a second circumference which is less than the first circumference and when fully stretched, enables the towel body at the distal edge to reach the first circumference;

a proximal edge integral with the towel body which defines a rim at the second open end; and said longitudinal seam including an elastic strip formed from an elastic member having a second length that is substantially equal to half of the first length when relaxed but is stretchable at least to the first length, wherein said elastic strip, when relaxed, reduces the length of the towel body at the longitudinal seam and biases a portion of the proximal edge towards the distal edge so as to create a V-shaped indentation in the proximal edge, the V-shaped indention having a vertex located at the longitudinal seam.

2. The elongated wrist towel of claim 1, wherein said elastic rim included in said distal edge is continuous over the entire distal edge.

3. The elongated wrist towel of claim 1, wherein said elastic strip included in said longitudinal seam is continuous over the entire longitudinal seam.

4. The elongated wrist towel of claim 1, wherein the towel body is configured to stretch at the longitudinal seam to a length equal to the first length.

5. An elongated wrist towel, comprising:

a towel body configured as a hollow, discrete sleeve with a first open end and an opposing second open end, wherein said towel body includes a longitudinal seam that extends between the first open end and the second open end;

said towel body having a first circumference and a first length, with the first circumference being the circumference of the towel body as measured at a location between the first open end and the second open end, and the first length being a longitudinal length of the towel base as measured at a location on the towel body that is opposite to the longitudinal seam;

a distal edge integral with the towel body which defines an elastic rim at the first open end, wherein said distal edge, when relaxed, reduces the circumference of the towel body at the distal edge to a second circumference which is less than the first circumference and when fully stretched, enables the towel body at the distal edge to reach the first circumference;

a proximal edge integral with the towel body which defines a rim at the second open end; and said longitudinal seam including an elastic strip formed from an elastic member having a second length that is less than the first length when relaxed but is stretchable at least to the first length, wherein said elastic strip, when relaxed, reduces the length of the towel body at the longitudinal seam and biases a portion of the proximal edge towards the distal edge so as to create a V-shaped indentation in the proximal edge, the V-shaped indention having a vertex located at the longitudinal seam, the V-shaped indention having a length substantially equal to an eighth of the first length.

6. The elongated wrist towel of claim 5, wherein said elastic rim included in said distal edge is continuous over the entire distal edge.

7. The elongated wrist towel of claim 5, wherein said elastic strip included in said longitudinal seam is continuous over the entire longitudinal seam.

8. The elongated wrist towel of claim 5, wherein the towel body is configured to stretch at the longitudinal seam to a length equal to the first length.

9. An elongated wrist towel, comprising:

a towel body configured as a hollow, discrete sleeve with a first open end and an opposing second open end, wherein said towel body includes a longitudinal seam that extends between the first open end and the second open end;

said towel body having a first circumference and a first length, with the first circumference being the circumference of the towel body as measured at a location between the first open end and the second open end, and the first length being a longitudinal length of the towel base as measured at a location on the towel body that is opposite to the longitudinal seam;

a distal edge integral with the towel body which defines an elastic rim at the first open end, wherein said distal edge, when relaxed, reduces the circumference of the towel body at the distal edge to a second circumference which is less than the first circumference and when fully stretched, enables the towel body at the distal edge to reach the first circumference;

a proximal edge integral with the towel body which defines a rim at the second open end; and said longitudinal seam including an elastic strip formed from an elastic member having a second length that is substantially equal to half of the first length when relaxed but is stretchable at least to the first length, wherein said elastic strip, when relaxed, reduces the length of the towel body at the longitudinal seam and biases a portion of the proximal edge towards the distal edge so as to create a V-shaped indentation in the proximal edge, the V-shaped indentation having a vertex located at the longitudinal seam, the V-shaped indentation having a length substantially equal to an eighth of the first length.

10. The elongated wrist towel of claim 9, wherein said elastic rim included in said distal edge is continuous over the entire distal edge.

11. The elongated wrist towel of claim 9, wherein said elastic strip included in said longitudinal seam is continuous over the entire longitudinal seam.

12. The elongated wrist towel of claim 9, wherein the towel body is configured to stretch at the longitudinal seam to a length equal to the first length.

* * * * *